US005786749A

United States Patent [19]

Johnson et al.

[11] Patent Number: 5,786,749

[45] Date of Patent: Jul. 28, 1998

[54] TOOTHBRUSH HOLDER WITH INTEGRATED AUTOMATIC SOUND DEVICE

[76] Inventors: Cynthia Johnson, 2112 Shillingwood Dr., Kennesaw, Ga. 30152; Suzette Sweeny, 3021 High Vista Walk, Woodstock, Ga. 30189

[21] Appl. No.: 852,693

[22] Filed: May 7, 1997

[51] Int. Cl.[6] ..... G08B 3/10

[52] U.S. Cl. ..... 340/384.7; 340/384.1; 340/691; 340/693; 206/362; 206/362.2; 248/111; 248/312.1; 211/65

[58] Field of Search ..... 340/384.1, 384.7, 340/686, 691, 693; 206/15.2, 217, 362, 362.2; 248/108, 110, 111, 312.1; 211/65

[56] References Cited

U.S. PATENT DOCUMENTS

| | | | |
|---|---|---|---|
| 3,867,096 | 2/1975 | Doucette | 206/209 |
| 3,884,635 | 5/1975 | Sloan | 206/209 |
| 4,978,003 | 12/1990 | Foster | 206/217 |
| 4,979,708 | 12/1990 | Aoki | 248/110 |
| 5,086,916 | 2/1992 | Gray | 206/209.1 |
| 5,295,575 | 3/1994 | Gonzales | 206/216 |
| 5,375,711 | 12/1994 | Bree et al. | 206/362.2 |
| 5,575,383 | 11/1996 | Seeley | 340/384.7 |

*Primary Examiner*—Jeffery A. Hofsass
*Assistant Examiner*—Daniel J. Wu
*Attorney, Agent, or Firm*—Kenneth L. Tolar

[57] ABSTRACT

The present invention relates to a toothbrush holder having a micro-cassette player mounted within its interior. The holder has a plurality of plates extending from a base unit and each plate has apertures for receiving and holding toothbrushes. The cassette player is electrically connected to micro-switches contained within each aperture on the plates. Whenever a toothbrush is removed from an aperture, the cassette player automatically begins playing any one of a number of pre-selected recordings or messages. The exterior of the device may be interchangeably decorated depending upon the age group or sex of the user.

10 Claims, 2 Drawing Sheets

TOOTHBRUSH HOLDER WITH INTEGRATED AUTOMATIC SOUND DEVICE

BACKGROUND OF THE INVENTION

The present invention relates to a decorative toothbrush holder and accompanying disposable cup dispenser having an integrated micro-cassette recorder/player. Whenever a toothbrush is lifted from one of the holders, the micro-cassette player is activated automatically playing any one of several pre-recorded songs or messages. The device may be configured for any age group by changing the colors or graphic features thereon.

DESCRIPTION OF THE PRIOR ART

Toothbrush holders currently in use generally address the need to keep stored toothbrushes sterile or sanitary; however none of these devices are equipped with means for automatically playing a pre-recorded message or song. Accordingly there is a need for a toothbrush holder capable of playing music, inspirational or amusing messages or similar recordings thereby encouraging the user, especially a child, to brush his or her teeth.

U.S. Pat. No. 3,867,096 issued to Doucette discloses a toothbrush holder and accompanying drinking glass. The glass as well as any toothbrushes stored therein can be covered with a disinfectant cartridge to sanitize them after each use.

U.S. Pat. No. 3,884,635 issued to Sloane discloses a toothbrush holder that can hold several toothbrushes within a container. The container also contains sanitizing and dehydrating pellets to keep the toothbrushes stored therein clean and dry.

U.S. Pat. No. 5,086,916 issued to Gray discloses a toothbrush sterilization container and accompanying mounting bracket.

U.S. Pat. No. 4,978,003 issued to Foster discloses a toothbrush holder adapted to receive and store disposable cups As indicated above, none of the above described inventions provide a means for automatically playing pre-recorded messages or songs whenever the toothbrush holder is in use. Furthermore, none of the prior art devices disclose means for interchangeably decorating the exterior of a toothbrush holder.

SUMMARY OF THE INVENTION

The present invention provides a new and improved toothbrush holder which automatically play songs or other messages when in use. It is therefore an object of the invention to provide a toothbrush holder with a built in sound device that automatically plays any one of a variety of songs or pre-recorded messages whenever a user removes a toothbrush therefrom.

It is therefore another object of the present invention to provide a toothbrush holder that encourages children to brush their teeth longer and more often.

It is yet another object of the present invention to provide a toothbrush holder that is capable of entertaining the user while brushing his or her teeth.

It is yet another object of the present invention to provide a toothbrush holder that can be interchangeably decorated as the user wishes or to target a particular age group or gender. Other objects, features and advantages of the present invention, its details of construction and arrangement of parts will be seen from the following description of the preferred embodiments when considered with the attached drawings and from the appended claims.

DESCRIPTION OF THE PREFERRED EMBODIMENT

Figure 1:
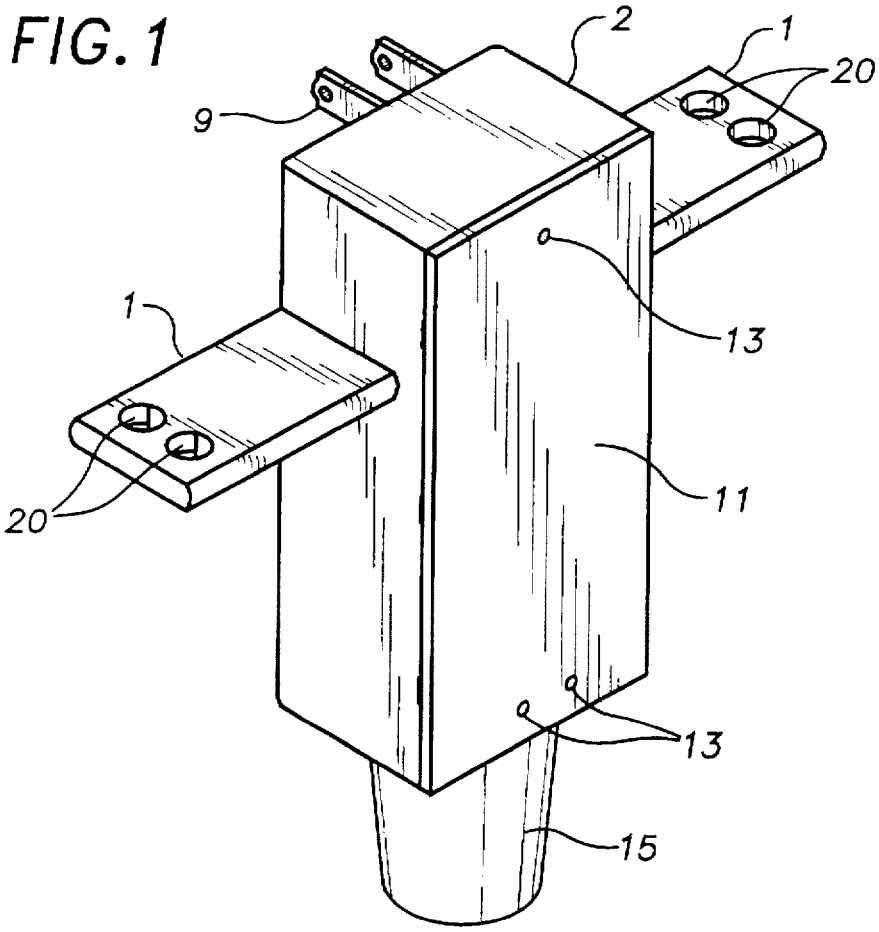
FIG. 1 depicts the inventive device with its hinged door in the closed position. Also pictured is an example of a decorative design that can be removably attached to the hinged door.
Figure 1A:
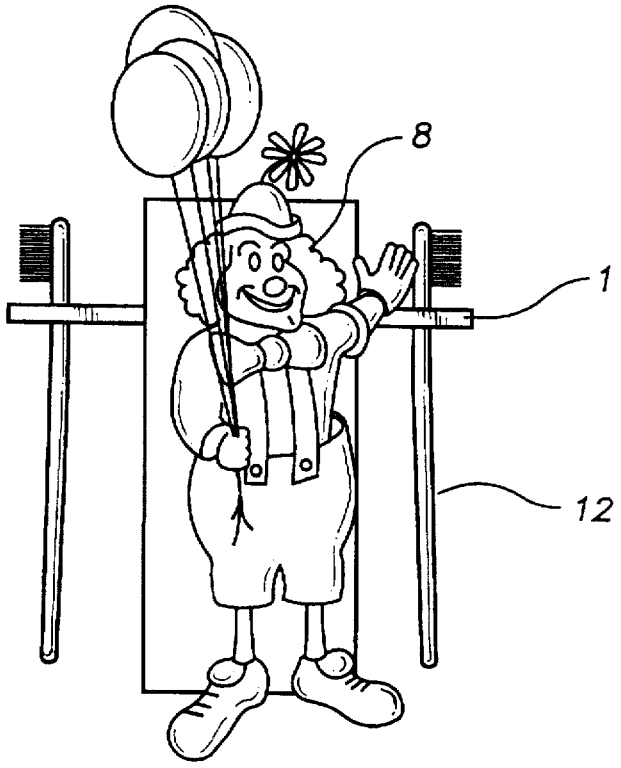
Figure 2:
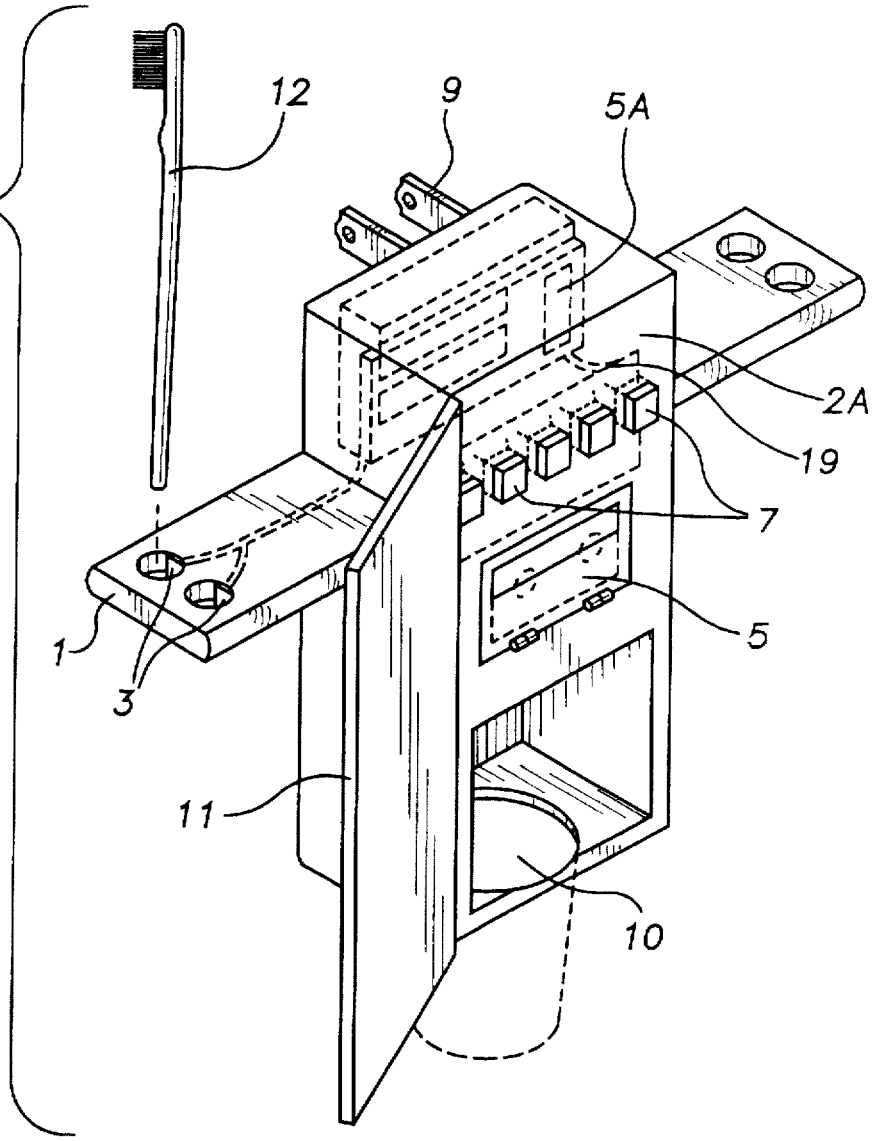
FIG. 2 depicts the inventive device with the hinged door in the open position revealing the micro-cassette recorder and its control buttons mounted therein. A dispensing cup is shown in phantom as it would be stored in the disposable cup dispenser. Also shown in detail is one of the plurality of holes and a micro-switch received therein.
Figure 2A:
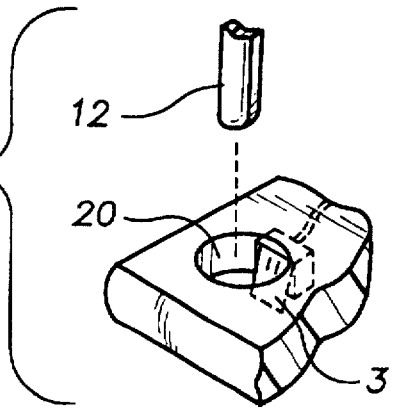

Referring now to FIGS. 1 and 2, the invention comprises a substantially rectangular hollow, box type, base unit 2 having at least two exterior sides and a horizontal bottom surface. Mounted on each of two opposite exterior sides of the base unit 2 and extending substantially horizontally therefrom are one or more plates 1 each having a plurality of apertures 20 for receiving and retaining a toothbrush 12. Received within each aperture 20 is a micro-switch 3.

The hollow portion of the box type base unit 2 defines an interior chamber 2A. A hinged door 11 is attached to the base unit 2 providing access to the interior chamber 2A. Received within the interior chamber 2A of the base unit 2 is micro-cassette recorder/player 5 and its basic control function buttons 7- play, record, rewind, fast-forward, etc.

A 120 Volt AC power plug 9 is mounted on the exterior of the base unit 2 and is electrically connected to the micro-cassette recorder/player 5. A DC transformer is electrically connected to the 120 Volt AC plug 9 to provide 3 to 9 volts DC power to the micro-cassette player 5. The placement of the plug 9 and the transformer is not critical to the operation of the device but the plug and transformer would probably be best placed on a side of the base unit 2 opposite the hinged door 11 allowing the device to be easily attached to an electrical wall socket. Alternatively, the device could be designed to operate on batteries for counter top applications.

The micro-cassette player 5 comprises the internal electrical components 5A found in standard off-the-shelf devices generally known in the prior art less the exterior casing. The player/recorder 5 is mounted within the interior chamber of the base unit 2 using numerous integrally molded tabs within the interior chamber 2A of the base unit 2 or any other similar mounting or attachment means.

The cassette player has a remote on/offjack 14. The remote jack 14 is electrically connected to each of the switches 3 contained within the apertures 20 on the plates 1. The switches 3 are spring contacted and normally closed (N/C) which make a closed switch contact whenever a brush 12 is removed. The switches 3 are electrically connected in parallel to the remote on/offjack 14 so that removal of any one toothbrush 12 will activate the cassette player 5. In order for the cassette remote on/off switch 14 mechanism to operate properly, the play button 7 must be maintained in the depressed position.

The horizontal bottom surface of the base unit 2 has a large circular aperture 10 therethrough which may be used as a disposable cup 15 dispenser. The exterior of the door 11 can be decorated with a variety of attractive graphics such as the clown doll 8 pictured in FIG. 1. The interchangeable decorations 8 may be attached to the exterior of the door by means of three female aperture connectors 13 on the exterior of the door 11. Each decoration or figurine 8 would have accompanying mating male protrusions thereon for inserting into the apertures on the door.

The device is activated by first depressing the play button 7. Whenever a toothbrush 12 is removed from one of the apertures 20 on a plate 1, a closed circuit results and a signal is sent to the remote on/offjack 14, activating the micro cassette recorder/player. Any number of preselected, prerecorded songs or messages could then be played depending upon the cassette inserted by the user. When a toothbrush 12 is returned to a plate 1, the cassette player stops, and automatically rewinds the tape if the tape has reached its end. From the above description, it is now apparent that the new invention provides a new and improved toothbrush holder that is capable of automatically playing music or inspirational messages and the exterior of which may be selectively, interchangeably decorated. It is understood that although there has been shown and described the preferred embodiment of the above described invention that this invention is not to be limited to the exact arrangement of parts shown in the accompanying drawings or described in the specification and that modifications may be made to the invention which do not exceed the scope of the appended claims. Accordingly, the scope of our invention is to be limited only by the following claims:

We claim:

1. A toothbrush holder with integrated automatic sound device comprising:

a. a base unit;

b. a substantially horizontal plate attached to said base unit having a plurality of apertures thereon for receiving a toothbrush;

c. means for automatically playing preselected sound recordings whenever a toothbrush is removed from one of the apertures.

2. A toothbrush holder according to claim 1 wherein said base unit is hollow and has an exterior; said hollow portion defining an interior chamber.

3. A toothbrush holder according to claim 1 further comprising means to store disposable cups.

4. A toothbrush holder according to claim 1 further comprising a means for providing electrical power to said automatic playing means.

5. A toothbrush holder according to claim 2 further comprising a door hingably engaging said base unit providing selective access to the interior chamber.

6. A toothbrush holder according to claim 2 wherein said means for automatically playing sound recordings comprises:

a. a plurality of micro-switches received within said apertures;

b. a sound device means having a remote on/off means electrically connected to said micro-switches.

7. A toothbrush holder according to claim 4 wherein said power means comprises:

a. An AC plug attached to said base unit;

b. A DC transformer electrically connected to said plug and said playing means.

8. A toothbrush holder according to claim 5 further comprising means for interchangeably and selectively decorating the exterior of said base unit.

9. A toothbrush holder according to claim 6 wherein said sound device means comprises:

a. a micro-cassette player received within the interior chamber of said base unit;

b. a plurality of control function means electrically and mechanically connected to said micro-cassette player.

10. A toothbrush holder according to claim 8 wherein said means for interchangeably decorating the exterior comprises:

a a plurality of apertures on a side of said door, b. a decorative device having a plurality of male protrusions selectively engaging said apertures on said door whereby an unlimited number of interchangeable decorative devices may be attached to said door.

* * * * *